US009238254B1

(12) United States Patent
Davis

(10) Patent No.: US 9,238,254 B1
(45) Date of Patent: Jan. 19, 2016

(54) HELICAL DISC FOR USE IN A DISC SCREEN

(71) Applicant: Nicholas Davis, San Diego, CA (US)

(72) Inventor: Nicholas Davis, San Diego, CA (US)

(73) Assignee: CP Manufacturing, Inc., San Diego, CA (US)

( * ) Notice: Subject to any disclaimer, the term of this patent is extended or adjusted under 35 U.S.C. 154(b) by 0 days.

(21) Appl. No.: 14/811,164

(22) Filed: Jul. 28, 2015

Related U.S. Application Data

(63) Continuation of application No. 14/809,238, filed on Jul. 26, 2015.

(60) Provisional application No. 62/160,219, filed on May 12, 2015, provisional application No. 62/153,901, filed on Apr. 28, 2015.

(51) Int. Cl.
*B07B 1/15* (2006.01)
*B07B 1/46* (2006.01)

(52) U.S. Cl.
CPC ..... *B07B 1/15* (2013.01); *B07B 1/4609* (2013.01)

(58) Field of Classification Search
CPC ..... B07B 1/14; B07B 1/15; Y10T 29/49554
USPC ..... 209/669, 672
See application file for complete search history.

(56) References Cited

U.S. PATENT DOCUMENTS 1,148,165 A * 7/1915 Hardie ..... B07B 1/14 209/668
1,766,340 A * 6/1930 Kendall ..... B07B 1/15 209/627
2,973,093 A * 2/1961 Erickson ..... B07B 1/14 198/787
3,028,957 A * 4/1962 Conway ..... B07B 1/15 209/672
3,306,441 A * 2/1967 Sanders ..... B02C 4/00 209/233
4,471,876 A * 9/1984 Stevenson, Jr. ..... A01D 17/06 15/3.11
4,953,712 A * 9/1990 Meester ..... B07B 1/15 198/663
6,264,043 B1 * 7/2001 Mobley ..... B07B 13/072 209/659
6,318,560 B2 * 11/2001 Davis ..... 209/667
7,261,209 B2 * 8/2007 Duncan ..... B07B 1/4627 209/271
7,581,648 B2 * 9/2009 Greenbank ..... B07B 13/07 209/621
8,424,684 B2 * 4/2013 Campbell ..... B07B 1/15 209/643
8,720,698 B2 * 5/2014 Petitpas ..... A22C 29/005 209/667
8,991,616 B2 * 3/2015 Parr ..... B07B 1/15 209/667
9,027,762 B2 * 5/2015 Davis ..... B07B 1/16 209/672
2011/0108467 A1 * 5/2011 Campbell ..... B07B 1/15 209/522
2011/0259799 A1 * 10/2011 Paron ..... B07B 1/15 209/363

* cited by examiner

*Primary Examiner* — Joseph C Rodriguez
(74) *Attorney, Agent, or Firm* — Manuel de la Cerra

(57) ABSTRACT

A disc for use in a disc screen is disclosed that creates an "intended space"—i.e., the designed space through which material is intended to pass—that undulates in both directions in the plane defined by the screen's rotatable shafts. The disc design includes a major axis that is rotated along the length of the shaft, creating a helical ridge. The ridge is continuous and non-stepwise, thereby avoiding the "pinch" of the prior art designs. And by having the helical ridge of adjacent discs on the same shaft with opposing rotations, the lateral movement of material may alternate along the length of the shaft—further spreading the material throughout the width of the disc screen and increasing the screen's efficiency.

23 Claims, 13 Drawing Sheets

Position A

Position B

Position C

Position D

Position E

HELICAL DISC FOR USE IN A DISC SCREEN

CLAIM OF PRIORITY

This application claim priority as the non-provisional of U.S. Patent Applications 62/160,219 filed on May 12, 2015, and 62/153,901 filed on Apr. 28, 2015, and also claims priority as a continuation of U.S. patent application Ser. No. 14/809,2638 filed on Jul. 26, 2015. The entire contents of these applications are incorporated herein by reference.

This application is also related to U.S. Patent Application 62/037,038 filed on Aug. 13, 2014, converted to non-provisional application Ser. No. 14/797,088 filed on Jul. 11, 2015; U.S. Patent Application 62/153,901 filed on Apr. 28, 2015, converted to non-provisional application Ser. No. 14/797,090 filed on Jul. 11, 2015; and U.S. patent application Ser. No. 14/797,093 filed on Jul. 11, 2015; all of which are assigned to the same assignee and have a common inventor with the present application. Each of these applications is incorporated herein by reference.

TECHNICAL FIELD

The present invention relates generally to machines used to separate particulate materials or mixed recyclable materials into difference fractions, and more particularly, to a disc construction for a disc screen.

BACKGROUND

Material recycling has become an important industry in recent years due to decreasing landfill capacity, environmental concerns and dwindling natural resources. Many industries and communities have adopted voluntary and mandatory recycling programs for reusable materials. Solid waste and trash that is collected from homes, apartments and companies often combine several types of recyclable materials into one container. When brought to a processing center, the recyclable materials are frequently mixed together in a heterogeneous mass of material. Mixed recyclable materials include newspaper, clean mixed paper, magazines, aluminum cans, plastic bottles, glass bottles and other materials that may be recycled.

Disc screens are increasingly used to separate streams of mixed recyclable materials into respective streams or collections of similar materials. This process is referred to as classifying, and the results are called classification. A disc screen typically includes a frame in which a plurality of rotatable shafts is mounted in a parallel relationship. A plurality of discs is mounted on each shaft and a chain drive commonly rotates the shafts in the same direction. The discs on one shaft interleave with the discs on each adjacent shaft to form screen openings—i.e., the intended space—between the peripheral edges of the discs. The size of the intended space determines the dimension (and thus the type) of material that will fall through the screen. Rotation of the discs agitates the mixed recyclable materials to enhance classification. The rotating discs propel across the screen the larger articles which are too big to fall between the discs. The general flow direction extends from an input area where the stream of material pours onto the disc screen to an output where the larger articles pour off of the disc screen. The smaller articles fall between the discs onto another disc screen or a conveyor, or into a collection bin.

The prior art disc screens, however, have several shortcomings. First, the discs used to make up the screen are generally of the same diameter and therefore there is little lateral agitation, resulting in the majority of material remaining in the position where the material is initially deposited. The edges of the disc screen therefore are underutilized. Second, when the discs are of varying diameters, the change in diameter is by way of a step function. This then creates a gap between discs that is not intended to be used for sorting or classifying the material. Consequently, material can become "pinched" in these unintended gaps, damaging the discs and reducing the overall efficiency of the disc screen.

What is therefore needed is a disc for use in a disc screen that overcomes these deficiencies.

SUMMARY

What is disclosed and claimed herein is a disc for use in a disc screen having at least one shaft onto which the disc is mounted, the shaft defining a longitudinal axis. The disc includes a body with a central opening into which the shaft is disposed where the body extends a length along the longitudinal axis. The body also has a first major axis and a first minor axis, as defined by a first cross section taken perpendicular to the longitudinal axis at a first position along the length. The first major axis defines a first outer peripheral ridge with a diameter that is the distance from the first outer peripheral ridge to the center of the shaft. The first major axis is substantially horizontal. The body also includes a second major axis and a second minor axis, as defined by a second cross section taken perpendicular to the longitudinal axis at a second position along the length. The second major axis defines a second outer peripheral ridge wherein the second major axis is not substantially horizontal. A helical ridge in the direction of the longitudinal axis is formed by a substantially continuous and non-stepwise surface between the first and second outer peripheral ridges. The helical ridge substantially maintains the diameter between the first and second outer peripheral ridges.

The disc may have an angle of rotation greater than 15 degrees, where the angle of rotation is defined as the angle between a line originating at the center of the shaft and extending to the first outer peripheral ridge and a line originating at the center of the shaft and extending to the second outer peripheral ridge. That angle of rotation may be greater than 30 degrees, and can be at least 90 degrees. The body of the disc may be made of an elastomeric material. Further, the first outer peripheral ridge and the second peripheral ridge may be made of a material while the remainder of the body is made a different material. The first outer peripheral ridge and the second peripheral ridge may also be textured. The body may be constructed of more than one piece adapted to be fastened together around the shaft. The first cross section may have at least two major axes.

The discs may be used as part of a disc screen when mounted on a plurality of shafts.

The foregoing summary is illustrative only and is not meant to be exhaustive. Other aspects, objects, and advantages of this invention will be apparent to those of skill in the art upon reviewing the drawings, the disclosure, and the appended claims.

BRIEF DESCRIPTION OF THE DRAWINGS

Various aspects of certain example embodiments can be better understood with reference to the following figures. The components shown in the figures are not necessarily to scale, emphasis instead being placed on clearly illustrating example aspects and features. In the figures, like reference numerals designate corresponding parts throughout the different views and embodiments. Certain components and details may be omitted from the figures to improve clarity.

DETAILED DESCRIPTION OF EXAMPLE EMBODIMENTS

Following is a written description illustrating various aspects of non-limiting example embodiments. These examples are provided to enable a person of ordinary skill in the art to practice the full scope of the invention, including different examples, without having to engage in an undue amount of experimentation. As will be apparent to persons skilled in the art, further modifications and adaptations can be made without departing from the spirit and scope of the invention, which is limited only by the claims.

In the following description, numerous specific details are set forth in order to provide a thorough understanding. Particular example embodiments may be implemented without some or all of the disclosed features or specific details. Additionally, to improve clarity of the disclosure, some components well known to persons of skill in the art are not described in detail.

What is disclosed and claimed herein is a disc for use in a disc screen that creates an "intended space"—i.e., the designed space through which material is intended to pass—that undulates in both directions of the plane defined by the screen's rotatable shafts. The disc design includes a major axis that is rotated along the length of the shaft, creating a helical ridge. The helical ridge is continuous and non-stepwise, thereby avoiding the "pinch" of the prior art designs. And by having the helical ridge of adjacent discs on the same shaft with opposing rotations, the lateral movement of material may alternate along the length of the shaft—further spreading the material throughout the width of the disc screen and increasing the screen's efficiency.

Figure 1:
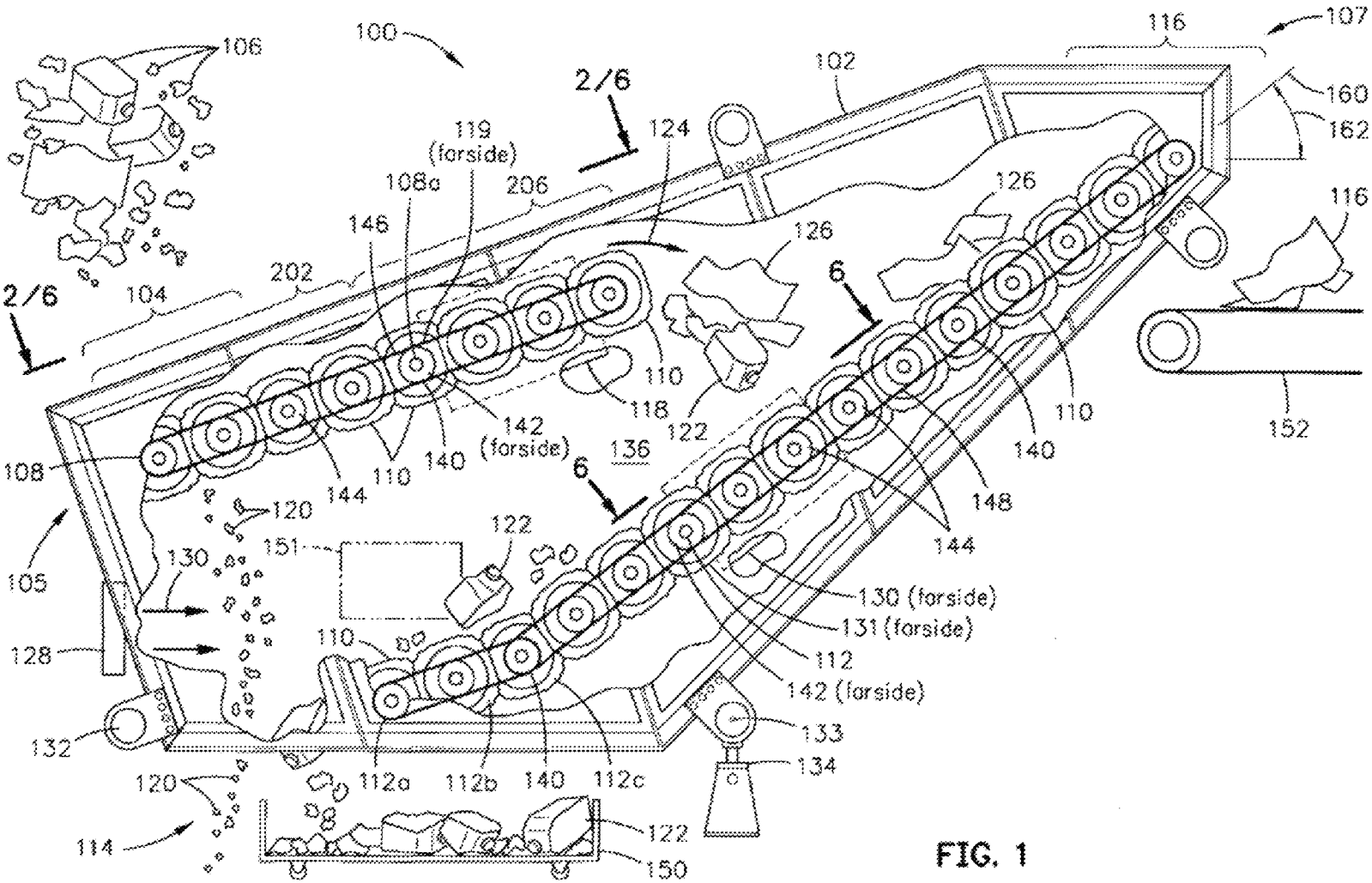
FIG. 1 is a side view of a disc screen machine.

Referring to FIG. 1, the apparatus, indicated generally by 100, includes a frame (or housing) 102, having a first plurality of rotatable shafts 108 ("first rotatable shafts") and a second plurality of rotatable shafts 112 ("second rotatable shafts") rotatably supported in the frame 102. A first motor 118 mounted on the frame 102 is coupled to a drive chain 119 that imparts a rotational force to the first rotatable shafts 108, while a second motor 130, also mounted on the frame 102, is coupled to a drive chain 131 that imparts a rotational force to the second rotatable shafts 112.

Preferably, the frame 102 is constructed using durable, heavy duty materials, such as steel. The precise shape of the frame 102, and its structure and layout, are subject to the design considerations and operational constraints of any particular application. However, in this example the frame 102 is a generally closed structure with a mixed material input area 104, a container discharge area 114 and a paper discharge area 116.

Although the frame 102 forms an enclosure, this is not absolutely necessary to the invention, but it may be required for safety reasons. The mixed material input area 104 is generally located near a first end 105 of the frame 102, where a heterogeneous material stream 106 of recyclable materials enters the apparatus. As can be seen in FIG. 1, the material stream 106 travels through the mixed material input area 104 and falls onto the first rotatable shafts 108. The first rotatable shafts 108 rotate in such a direction that the material stream 106 travels from the first end 105 of the apparatus toward a second end 107 of the apparatus in a general flow direction. Mounted on the first rotatable shafts 108 are a plurality of discs 110 that both agitate and propel the material stream 106. The discs 110 may be spaced on the shafts in a variety of patterns. Depending on the patterns of the discs 110, the material stream 106 starts to separate in one way or another. In this manner, the first rotatable shafts 108 with discs 110 act as a first disc screen. (Hereinafter, these terms are interchangeable.) In the preferred embodiment, the discs 110 are positioned in the first disc screen so that the material stream 106 is initially screened, with small materials 120 passing through the openings and larger materials continuing along the first rotatable shafts 108, all the while being agitated by the discs 110. At the end of the plane of first rotatable shafts 108, the larger materials fall onto the second rotatable shafts 112 (the direction shown as arrow 124). Mounted on the second rotatable shafts 112 are a plurality of discs 110. Thus, the second rotatable shafts with discs 110 act as a second disc screen, and these terms are interchangeable hereinafter. The discs 110 may be mounted on the second rotatable shafts in a variety of patterns. The second rotatable shafts 112 are generally positioned in an inclined plane 160 that has an angle 162. This inclined arrangement of the second rotatable shafts 112 allows heavier objects 122, such as bottles and cans, to bounce on the discs 110 and tumble backward and downward toward the container discharge area 114, finally falling out of the container discharge area 114 into a container or plenum 150. Lighter material, such as cardboard and paper, falling on the second disc screen does not bounce and is carried toward and upward to the paper discharge area 116. To assist in propelling the paper 126 toward the paper discharge area 116, one or more fans 128 may be mounted near the first end 105 of the frame to blow air 130 at the second rotatable shafts 112.

Figure 2C:
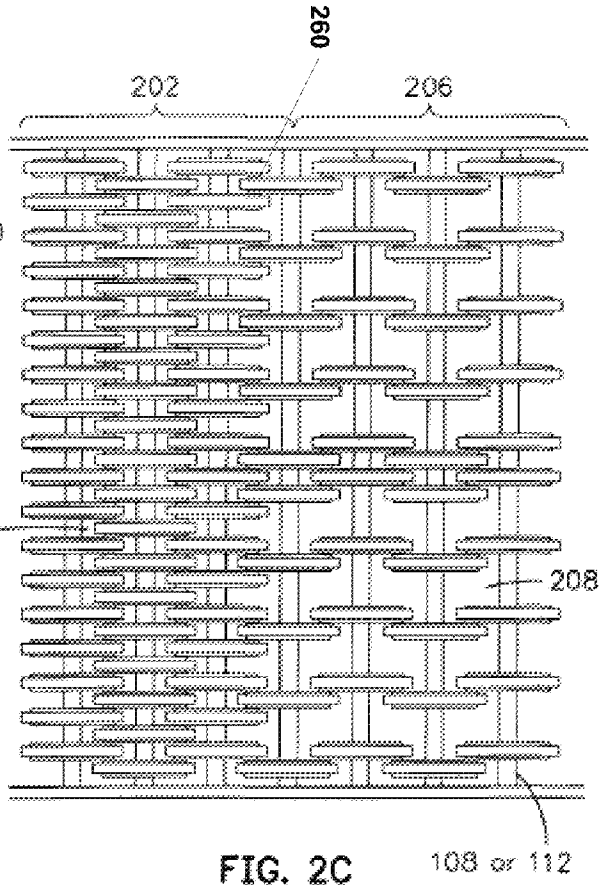
FIG. 2C is a top view of rotatable shafts and discs of FIG. 2A and FIG. 2B in a continuous disc screen.
Figure 2B:
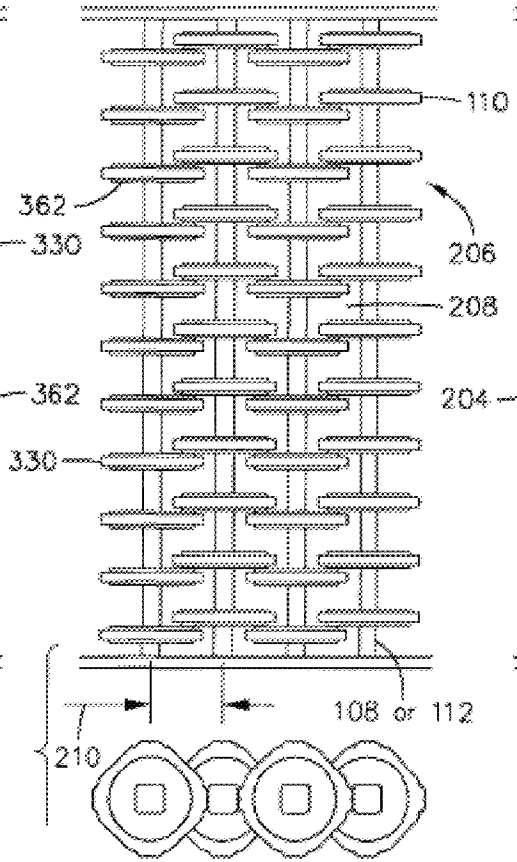
FIG. 2B is a top view of rotatable shafts and discs showing a screen configuration for separating larger materials than that of FIG. 2A.
Figure 2A:
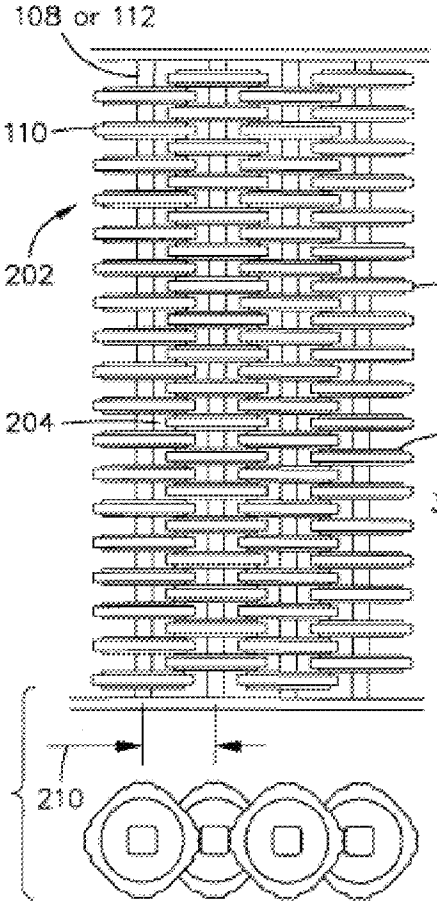
FIG. 2A is a top view of rotatable shafts and discs showing a screen configuration for separating smaller materials.

FIGS. 2A, 2B and 2C show examples of the discs 110 mounted on the first and second rotatable shafts 108 and 112, with varied spacing, creating a variety of screen patterns. FIGS. 2A and 2B show examples of two screen patterns 202 and 204 of the discs 110 mounted on the first rotatable shafts 108. FIG. 2A shows the discs 110 mounted on the shaft in a fine screen pattern, with small spaces between the edges of the discs 110 and adjacent shafts. One such space is indicated by 204. This fine screen pattern 202 is used in the apparatus where small materials are screened. In FIG. 2B, the discs 110 are mounted in a gross screen pattern 206 with large openings such as 208 such that larger, heavier materials are able to fall through the openings 208 between the discs 110. In some cases, it may be desirable to have a combination of spacings between the discs (i.e., have both small openings 204 and large openings 208). In this way, as the material stream travels along a plurality of rotating shafts, the mixed material is separated and screened in successive stages on one disc screen. One example combination pattern formed by varying the screen patterns is shown in FIG. 2C. In fact, this pattern describes the layout of the first disc screen. In this regard, as the material stream pours onto the disc screen apparatus in the inlet area 104 on the fine screen pattern 202, the material stream is agitated and moved by rotation of the discs with the shafts toward and over the gross screen pattern 206. Over the fine screen pattern 202, relatively fine grit, glass shards, and other small materials are screened out. Over the gross screen pattern 206, larger objects such as cans, bottles, and envelopes pour through the larger openings onto the lower end of the second rotatable shafts 112. In the preferred embodiment, the entire second disc screen has the gross screen pattern 206 of FIG. 2B.

In the apparatus 100, the first and second rotatable shafts 108 and 112 extend through and are supported between sides 136 (near side shown in FIG. 1) and 138 (far side) of the frame 102. The first rotatable shafts 108 are located in a first plane and the second rotatable shafts 112 are located below and partially underneath the first rotatable shafts 108 in an overlapping manner, with the first three shafts 112*a*, 112*b*, and 112*c* defining a plane that is parallel to that of the first rotatable shafts 108, and the remaining twelve defining a second plane. In the preferred embodiment, the first plane is generally disposed at a slight incline from horizontal to assist in the initial separation of the material stream 106. The first plane angle may vary from 0 to 45 degrees, with the preferred embodiment angle being 20 degrees. The second plane is generally disposed at an inclined angle such that the larger objects 122 do not readily go up the incline. The angle may vary from 25 to 60 degrees with the preferred embodiment angle being 35 to 45 degrees. In one embodiment, the frame 102 is mounted at a fixed first point 132 and a rotatable second point 133. The frame 102 may be rotated up or down, with the first point 132 as the pivot point, to alter an incline angle of the frame 102 using a jack 134 at the second point 133. This rotation of the frame up or down may also be used to vary the angles of the shafts.

The number of shafts is dependent on the size of the machine 100 and on intershaft spacing. In the embodiment shown in FIG. 1, the number of shafts in the first plurality of rotatable shafts 108 is less than the number of shafts in the second plurality of rotatable shafts 112. In the FIG. 1, there are eight first rotatable shafts 108 and fifteen second rotatable shafts 112. The first shafts 108 and second shafts 112 are supported by bushings or bearings 140 positioned along sides 136 and 138.

The plurality of discs 110, made from a hard durable material with a high coefficient of friction, such as rubber, are mounted on the first rotatable shafts 108 and the second rotatable shafts 112 to form the screen patterns shown in FIGS. 2A-2C; however, the discs 110 may be mounted along the first rotatable shafts 108 and the second rotatable shafts 112 in a variety of spacing patterns. The discs 110 on adjacent shafts are offset on their respective shafts such that the discs 110 on one shaft fit between (interleave with) the discs on the other shaft without touching the other shaft. This is best seen in FIGS. 2A-2C.

In the preferred embodiment, the first motor 118 and second motor 130 are positioned on the side 138 (far side) of the frame 102. The motors 118 and 130 are shown with dashed lines. A drive chain 119 attaches between the motor 118 and a drive sprocket 142 mounted on the end of the first shaft 108*a* that is on the side 138 (far side). A plurality of rotation sprockets 144 are mounted at the end of each first shaft 108 that is on the side 136 (near side). A rotation chain 146 interconnects the plurality of rotation sprockets 144, as shown in FIG. 1. A drive chain 131 attaches between the motor 130 and a drive sprocket 142 on the end of the second shaft 112 that is on the side 138 (far side). A plurality of rotation sprockets 144 are located at the end of each second shaft 112 on the side 136 (near side). A rotation chain 148 interconnects the plurality of rotation sprockets 144. Safety covers (not shown) cover the plurality of rotation sprockets and rotation chains. There may also be access doors or panels 151 on the sides 136 and 138 to allow access or viewing of the interior of the machine.

The first motor 118 turns the drive chain 119 and drive sprocket 142, thereby rotating the first rotatable shaft 108*a* in a first direction. Since all of the first rotatable shafts 108 are interconnected by rotation sprockets 144 and the rotation chain 146, all of the first rotatable shafts 108 rotate together in the first direction at the same speed. The second motor 130 turns the drive chain 131 and the drive sprocket 142, thereby rotating the second rotatable shaft 112 in a second direction. Since all of the second rotatable shafts 112 are interconnected by the rotation sprockets 140 and the rotation chain 148, all of the second rotatable shafts 112 rotate together in the second direction at the same speed. The rotating second direction of the second rotatable shafts 112 is in the same direction as the rotating first direction of the first rotatable shafts 108. Each motor may rotate its plurality of shafts at a particular speed. In the illustrative embodiment, the rotation speed of the first rotatable shafts 108 is around 60-100 revolutions per minute (rpm) and the rotation speed of the second rotatable shafts 112 is around 200-300 rpm. Although the preferred embodiment couples the motors to the shafts by sprocket/chain drives, other couplings may be used including, but not limited to, transmission couplings, geared couplings, direct couplings, and so on. Alternatively, separate individual shafts may be powered by separate individual motors. Further, the motors may be stationed at positions other than those shown, both on and off the frame 102, as design and installation considerations dictate. The sizes of the motors are dependent on a number of factors such as the number of rollers, type of drive mechanism, and so on. For example, each may have a rating of around 3 HP, with a 90 degree worm drive.

The operation of the disc screen apparatus 100 is as follows. Initially, the material stream 106 pours upon the first disc screen in the material entry area 104. In the fine screen section 202 of the first disc screen, the material stream is agitated and small matter is screened out, falling downward through the apparatus 100 to be collected by conventional means. The material stream 106 is propelled upward by the rotation of the discs toward, over, and off of the gross screen section 206. As they pass over the gross screen section 206, intermediate-sized objects such as cans, twelve-ounce bottles and envelopes fall through the gross mesh onto to the lower end of the second rotatable shafts 112. Meanwhile, the larger objects of the material stream 106, including large containers, newspapers, and cardboard sections, are propelled off of the upper end of the first disc screen and onto the midsection of the second disc screen. Thus, the material stream 106 pours onto the second disc screen for screening already in a somewhat differentiated state, with smaller objects falling onto the lower rear portion of the second disc screen, and larger objects onto its midsection. The smaller objects are screened at the lower portion of the second disc screen, either passing through the gross screen pattern into the plenum 150 or tumbling downward off of the lower end of the second disc screen into the plenum 150. The larger objects that pour onto the midsection of the second disc screen separate, with the larger, heavier objects, such as large bottles and plastic containers, being bounced off of the screen and rolling downward toward the lower end of the second disc screen from which they fall into the plenum 150. Meanwhile, the larger light objects, such as newspapers, magazines, and cardboard sections, are carried upward by rotation of the second rotatable shafts 112 toward, over, and off of the upper end of the second disc screen from which they fall onto a collection conveyor 152. A distinct advantage of this operation is that the material stream 106 is classified essentially into three sections on the first disc screen. Advantageously, the second disc screen receives a material stream that has been partially classified into smaller heavier objects that pour onto the lower portion of the second disc screen and a mixture of larger heavy and light objects that pour onto the second disc screen in its midsection. This avoids the prior art problem of a single, large, very dense stream of material pouring onto a single disc screen, creating a large eddying slurry of undifferentiated material at its impact point. As is known, such a large slurry reduces the effectiveness of a disc screen, providing less sharply-differentiated collections of material than are afforded by the apparatus 100.

Figure 3A:
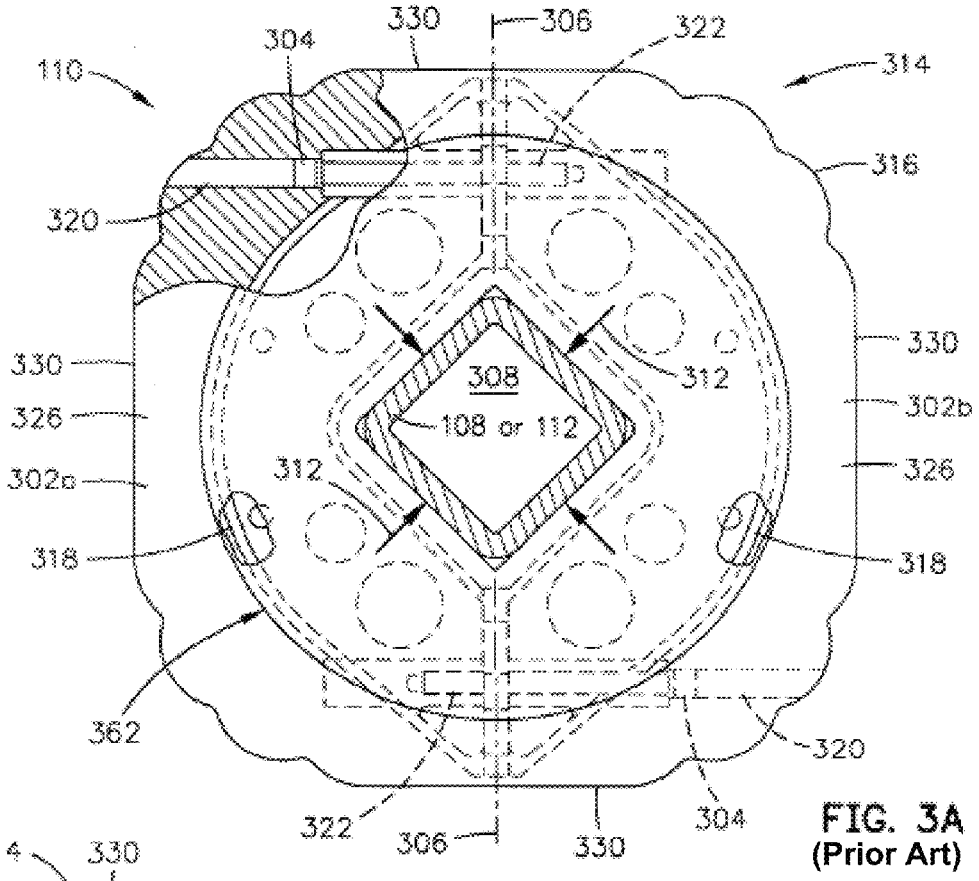
FIG. 3A (Prior Art)
FIG. 3A is a side elevation view of a prior art disc, with a portion cut away, showing certain elements with hidden lines.
Figure 3B:
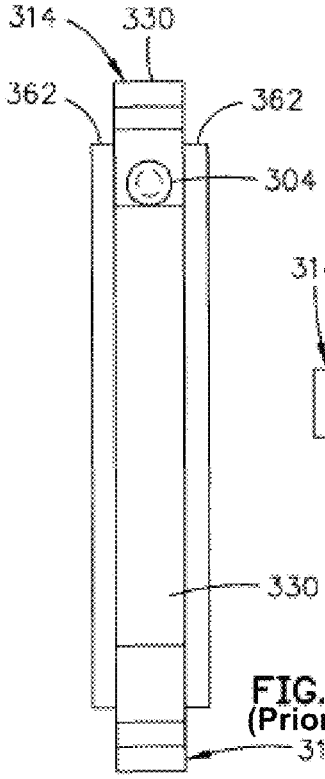
FIG. 3B (Prior Art)
FIG. 3B is an elevation view of an edge of the prior art disc of FIG. 3A.
Figure 3C:
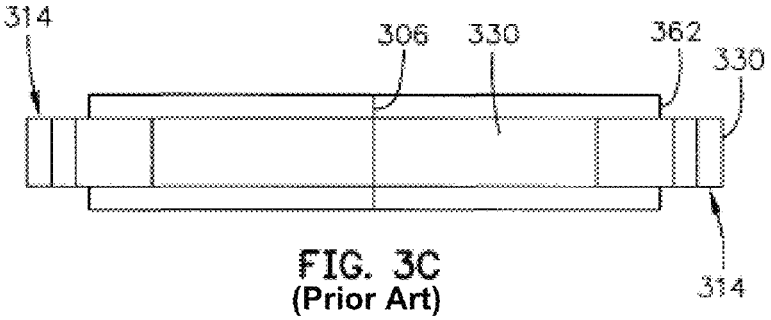
FIG. 3C (Prior Art)
FIG. 3C is a top plan view of an edge of the prior art disc of FIG. 3A.

FIGS. 3A-3C show details of a prior art disc 110. The disc 110 is designed to be replaceable on a shaft, without disassembly of the shaft and/or removal of other discs therefrom. The disc 110 is designed to separate into two portions at a separation plane 306 into a disc portion 302*a* and a disc portion 302*b*. Screws 304 clamp the disc halves 302*a* and 302*b* together. A central opening 308 of the disc 110 is designed to fit on the rotatable shafts 108 or 112. The central opening 308 comprises planar sections 312. As can be seen in the figures, the rotatable shafts 108 or 112 are eccentric (preferably square) in configuration. This provides more planar contact between the rotatable shaft and the disc. Because of the design of the disc 110, as the disc halves 302*a* and 302*b* are clamped around the rotatable shaft 108 or 112, the planar sections 312 make contact with the flat sides of the rotatable shafts at four clamping surfaces. This allows the disc 110 to clamp or grab a shaft 108 or 112 such that it will not freely spin on the shaft. This clamping design also eliminates the need for spacers or the like to be positioned between the discs 110 to create the desired screen patterns.

The disc 110 may be square in shape with an outer peripheral edge which includes four corners 314. In the illustrated embodiment, the corners 314 are radiused to reduce the wear on the disc 110 during use. The radiused corners may also be textured with a variety of patterns. This texturing may assist in the movement of materials with the disc 110. In the illustrative embodiment shown, the corners 314 are textured with a plurality of ridges 316. The outer peripheral edge of the disc 110 defines an annular impacting surface 330. Also shown in the figures is a cylindrical shoulder 362 or boss, integrally formed on and protruding from each side of the disc. The shoulder 362 allows for room between the impacting surfaces 330 of adjacent discs 110 when they are positioned in a fine mesh pattern. Further, the shoulders 362 of adjacent discs provide a lateral space within which the peripheral edge of an interleaved disc on an adjacent shaft may be received to create a small space such as the space 204 for fine material screening. (See FIG. 2A.)

As can be seen in FIGS. 3A-3C, the impacting surface 330 has a nearly constant diameter as measure from the center of the central opening 308. Any slight variation in the diameter is perpendicular to the longitudinal axis of the shaft 108 or 112. In other words, the slight variation in diameter is in the same plane as that shown in FIG. 3A.

FIGS. 2A, 2B and 2C illustrate several discs 110 mounted to the first and second rotatable shafts 108 and 112. Those discs 110 may be of different diameters, creating a step function when the effective disc diameter is measured along the length of the rotatable shafts 108 and 112. The operation of the disc screen with a disc 110 (shown in FIGS. 3A-3C) is such that material is sorted by creating a constant space through which material can fall through. For example, as shown in FIG. 2C, space 204 sorts for small pieces of material while space 208 sorts for larger pieces. These spaces (204 and 208) are the intended sorting spaces. As the disc screen is operated, these intended spaces (204 and 208) do not change in shape. Therefore, there is no lateral agitation within these intended spaces that would allow material that might be stuck to actually fall through the space. Also, material may get stuck between two discs (see for example position 260 in FIG. 2C) in an unintended sorting space, and that material can jam the screen and cause premature wear on the disc, reducing not only the efficiency of the disc screen but also increasing the cost of maintenance. Just as with the intended spaces 204 and 208, the unintended space shown at position 260 does not change shape during the operation of the disc screen. Therefore, there is no lateral agitation within this unintended space that would allow material that is stuck to actually dislodge. This is caused by the design of the system and the step-function profile of the diameters of the discs 110 used in the screen.

Figure 4A:
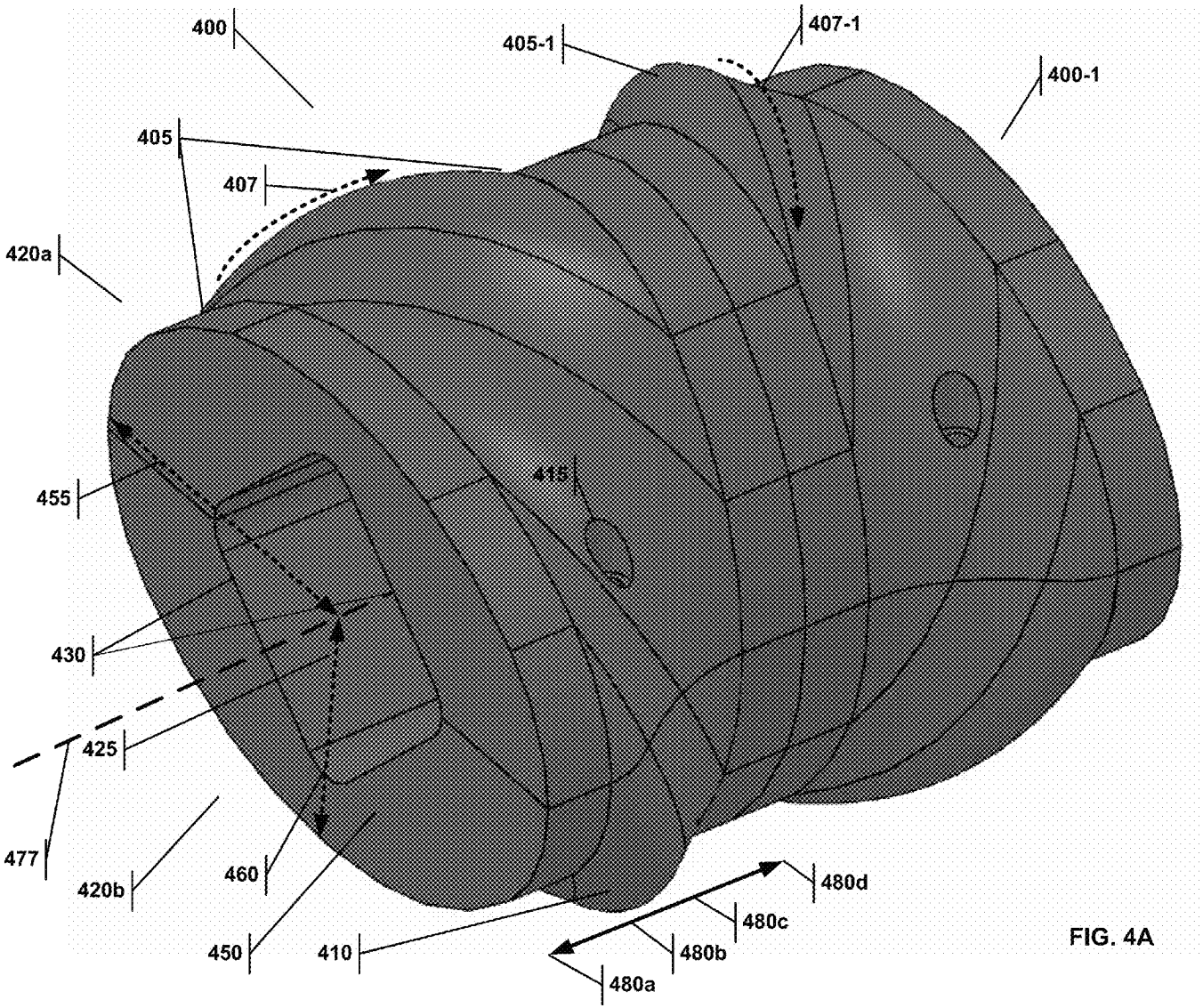
FIG. 4A is a perspective view of a helical disc described herein.

What is shown in FIG. 4A illustrates disc 400 that is used in a disc screen frame described above. The disc 400 has a helical ridge 405 (i.e., impacting surface) that forms a helical impacting surface about the longitudinal axis of the shaft. This disc can be formed of two halves 420*a* and 420*b* that are fastened together by screws 415 as shown in FIGS. 3A-3C. FIGS. 6-10 show various perspectives of the disc half, two of which make up a disc 400. Each half may have a helical ridge (405, 410), so when the halves are fastened together, the disc 400 has two helical ridges. Therefore, unlike the prior art, a single disc does not have a step-function profile diameter as measured along the longitudinal axis of the shaft, such that when two discs 400 are placed adjacent to each other, the intended space between the discs is constantly changing, causing lateral agitation.

Screws 415 clamp the disc halves 420*a* and 420*b* together. A central opening 425 of the disc 400 is designed to fit on the rotatable shafts 108 or 112. The central opening 425 comprises planar sections 430. As can be seen in the figures, the rotatable shafts 108 or 112 are eccentric (preferably square) in configuration. This provides more planar contact between the rotatable shaft and the disc. Because of the design of the disc 400, as the disc halves 420*a*, 420*b* are clamped around the rotatable shaft 108 or 112, the planar sections 430 make contact with the flat sides of the rotatable shafts at four clamping surfaces. This allows the disc 400 to clamp or grab a shaft 108 or 112 such that it will not freely spin on the shaft. This clamping design also eliminates the need for spacers or the like to be positioned between the discs 400 to create the desired screen patterns. A further description of the fastening design and structure is shown in U.S. Pat. No. 6,318,560 which is assigned to the same assignee as the present application. The '560 patent is fully incorporated by reference herein.

The end of the disc 400 (position 450) illustrates that disc 400 has a major axis 455 and a minor axis 460, extending from the center of the opening 425. The difference between these axes is the amplitude of the disc, and, as shown in FIGS. 5A-5E below, this causes the intended space (i.e., the space between adjacent discs) to move along the plane defined by the shafts upon which the discs 400 are mounted. This further helps to effectively separate material, and prevent jams, because the intended space is not only moving laterally (i.e., parallel to the shafts) but also within the shaft plane. Also, the helical ridge 405 is shown to sweep across the disc 400 (illustrated with arrow 407) to reach the union of the second disc 400-1. The helical ridge 405-1 of disc 400-1 also sweeps across the disc 400-1 (illustrated with arrow 407-1) to reach the union with the reach disc 400. Therefore, depending on the rotation of the two disc complex, the lateral movement of the intended space will either move material towards the union of discs 400 and 400-1 or away from the union. And when several of these discs are attached together (regardless of the rotation), lateral movement will be towards some unions and away from other unions. Therefore, this design actually allows the lateral movement to vary, further increasing the efficiency of the disc screen.

Figure 4B:
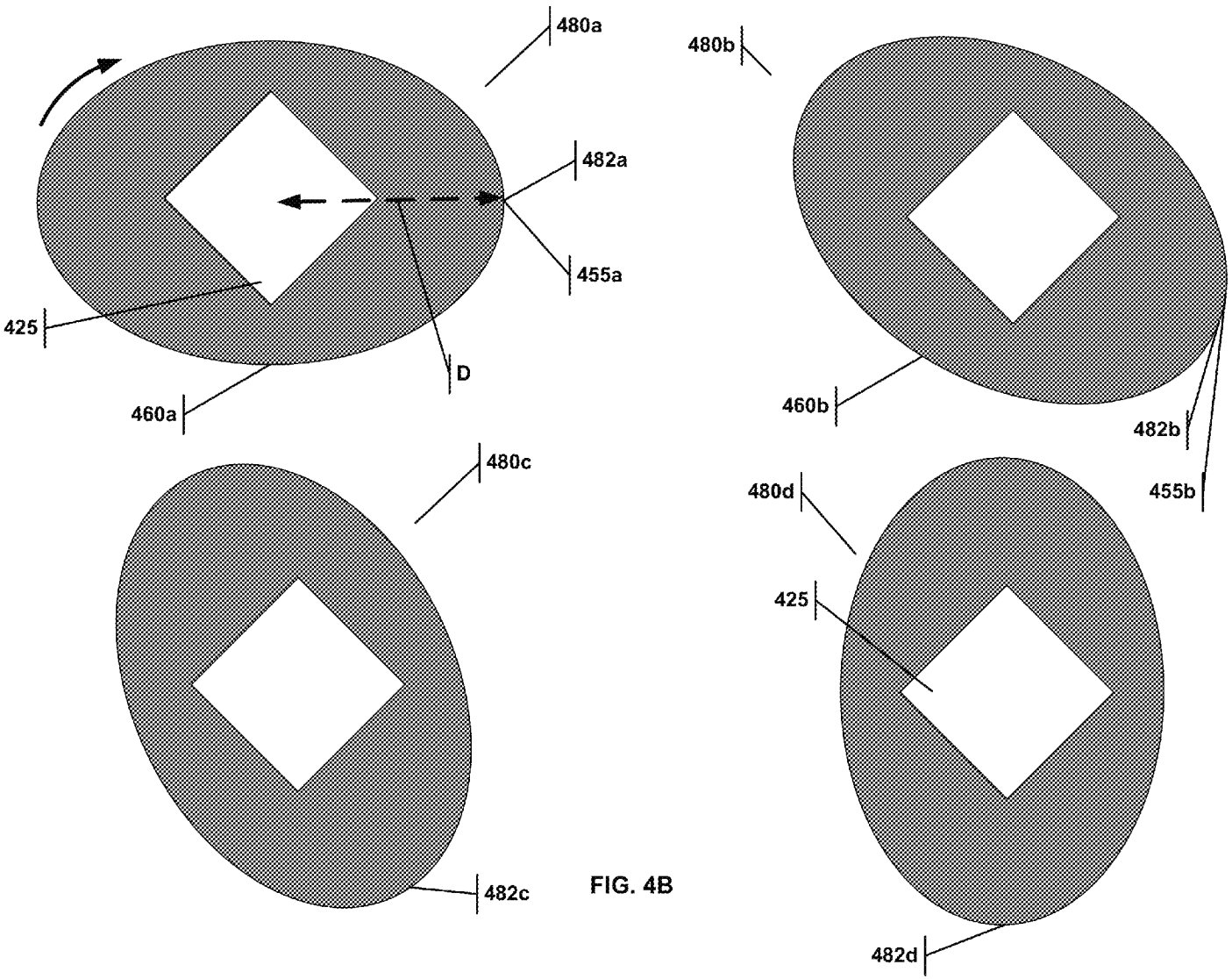
FIG. 4B illustrates various cross sections of the helical disc illustrated in FIG. 4A.

To better visualize the helical disc 400, serial cross sections of the disc 400 are presented in FIG. 4B. The first cross section, taken perpendicular to the longitudinal axis of the shaft (shown as dashed line 477), is at position 480*a*, which as seen in FIG. 4A is a union point to an adjacent helical disc. The cross sectional shape of the disc 400 is an oval having two outer peripheral edges on the major axis, at 180 degrees from each other. The last cross section is at position 480*d*, which, as shown in FIG. 4A, is the union point to the other adjacent helical disc. Two intermediate cross section positions are also provided, 480B and 480*c*. FIG. 4B illustrates the cross sections at positions 480*a*, 480*b*, 480*c* and 480*d*. The first cross section 480*a* shows the major axis 455*a* in a horizontal position, while the minor axis 460*a* is vertical. On the edge of the major axis 455*a* is an outer peripheral edge 482*a* that is at a distance, or diameter, D from the center of the longitudinal axis of the shaft. At the second cross section 480*b*, the major axis 455*b* and the minor axis 460*b* have moved from the horizontal and vertical position respectively. The outer peripheral edge 482*b* is at the tip of the major axis 455*b*. The transition between the various cross sections is smooth and continuous so as to avoid a step function in the direction along the longitudinal axis of the shaft. Each cross section illustrated is a 30 degree rotation from the previous position (but note that the central opening 425 is the same diamond shape traveling through the helical disc). The result is that the outer peripheral edges (482*a*, 482*b*, 482*c*, 482*d*) form the helical ridge described above, where the helical ridge maintains the diameter D.

Figure 5A:
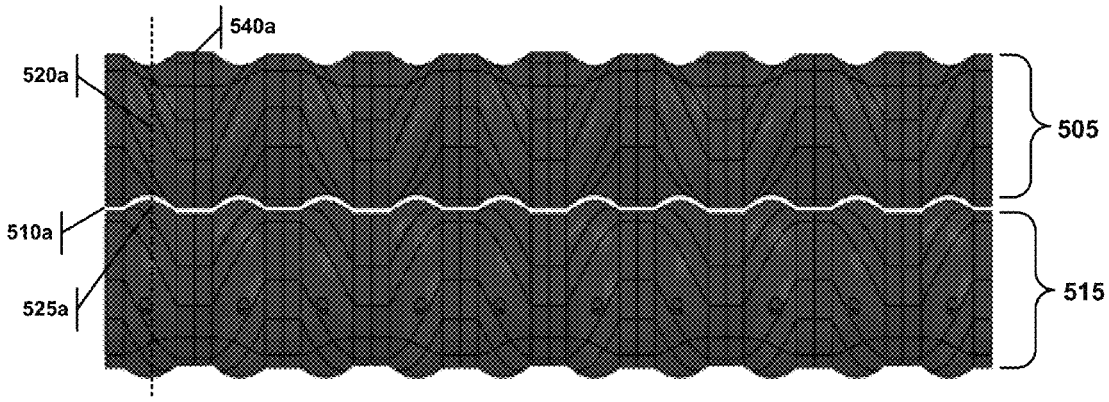
FIG. 5A is a top view of a disc screen with the plurality of helical discs in position A.

FIGS. 5A-5E is a top view of a portion of a disc screen 500 that is comprised of several discs just described with reference to FIGS. 4A, 4B, and 6-10. The upper plurality of discs 505 forms an intended space (510*a*, 510*b*, 510*c*, 510*d*, 510*e*) with the lower plurality of discs 515. The upper plurality 500 is identical to the lower plurality 505, except that they are placed on the shaft out of phase by 90 degrees from each other. In FIG. 5A the intended space 510*a* is shown at rotational position A, but when the discs 400 are rotated 45 degrees to a rotational position B, the intended space 510*a* has changed to 510*b*. As the rotational position is further changed to positions C, D and E, the intended space 510*b* changes to intended spaces 510*c*, 510*d* and 510*e*, respectively. This intended space change forms a wave that can dislodge materials because of its lateral movement. In this embodiment, other than the intended space (510*a*, 510*b*, 510*c*, 510*d*, 510*e*) there is no unintended spacing into which material can inadvertently fall and jam the discs.

Figure 5B:
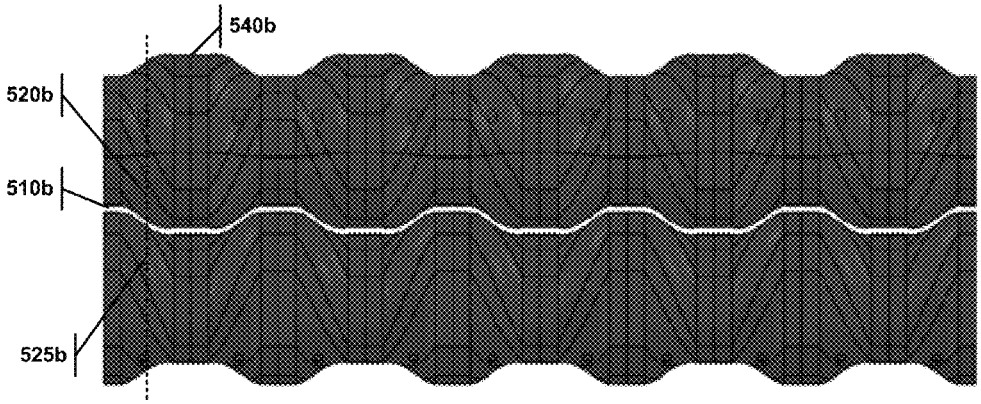
FIG. 5B is a top view of a disc screen with the plurality of helical discs in position B.
Figure 5C:
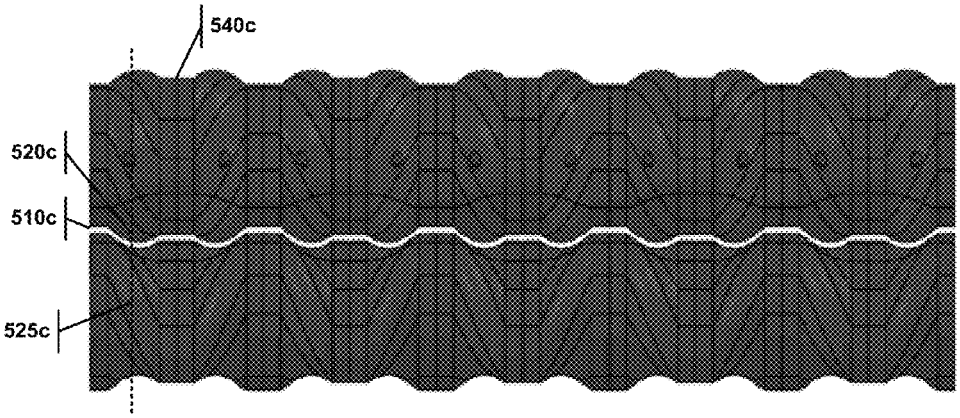
FIG. 5C is a top view of a disc screen with the plurality of helical discs in position C.
Figure 5D:
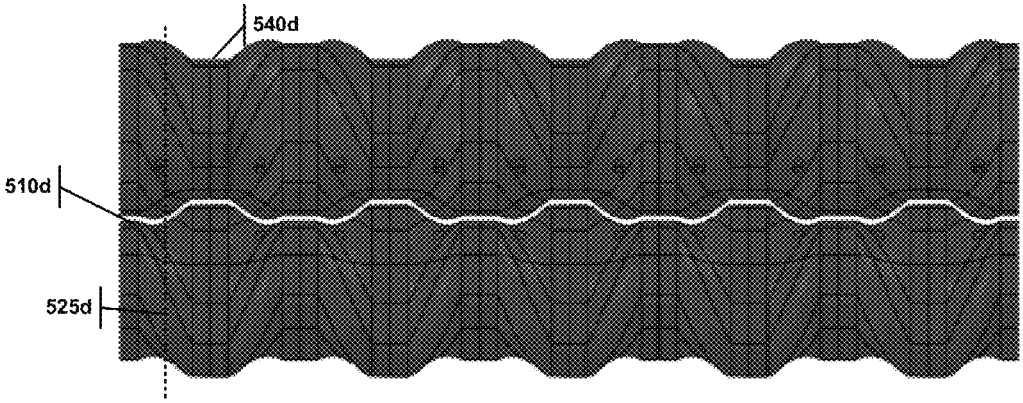
FIG. 5D is a top view of a disc screen with the plurality of helical discs in position D.
Figure 5E:
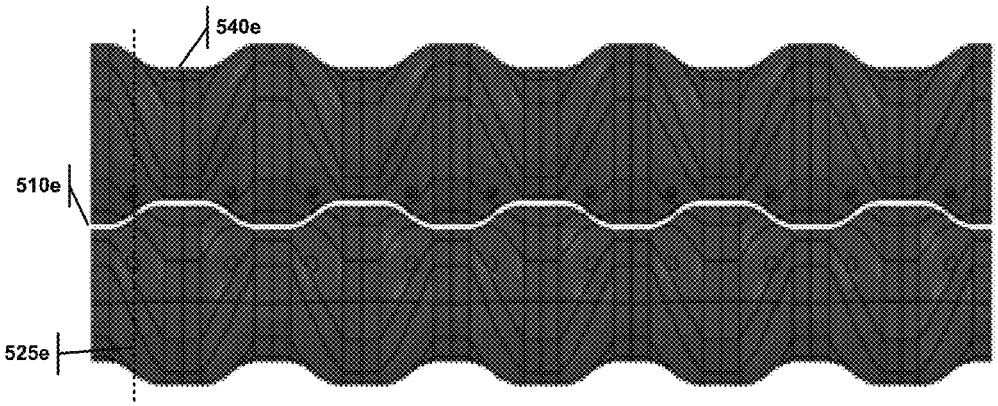
FIG. 5E is a top view of a disc screen with the plurality of helical discs in position E.
Figure 6:
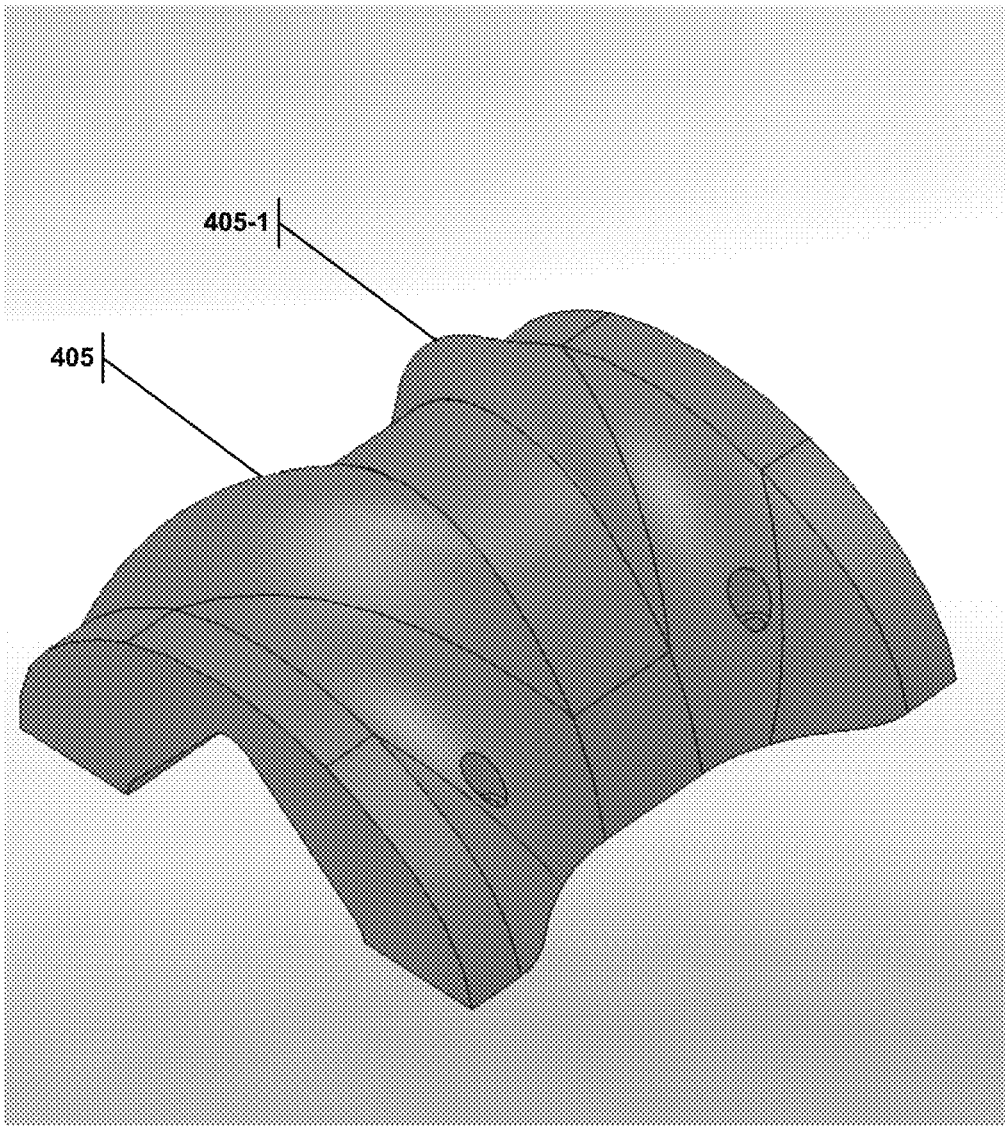
FIG. 6 is a perspective view of a half of a helical disc described herein.
Figure 7:
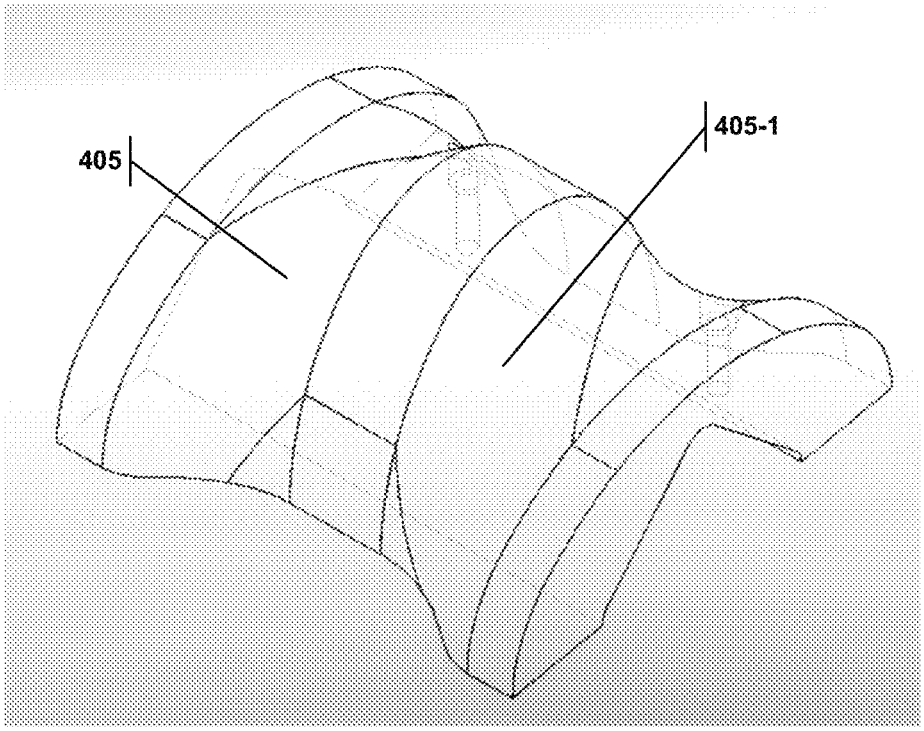
FIG. 7 is a perspective view of a half of a helical disc described herein.
Figure 8:
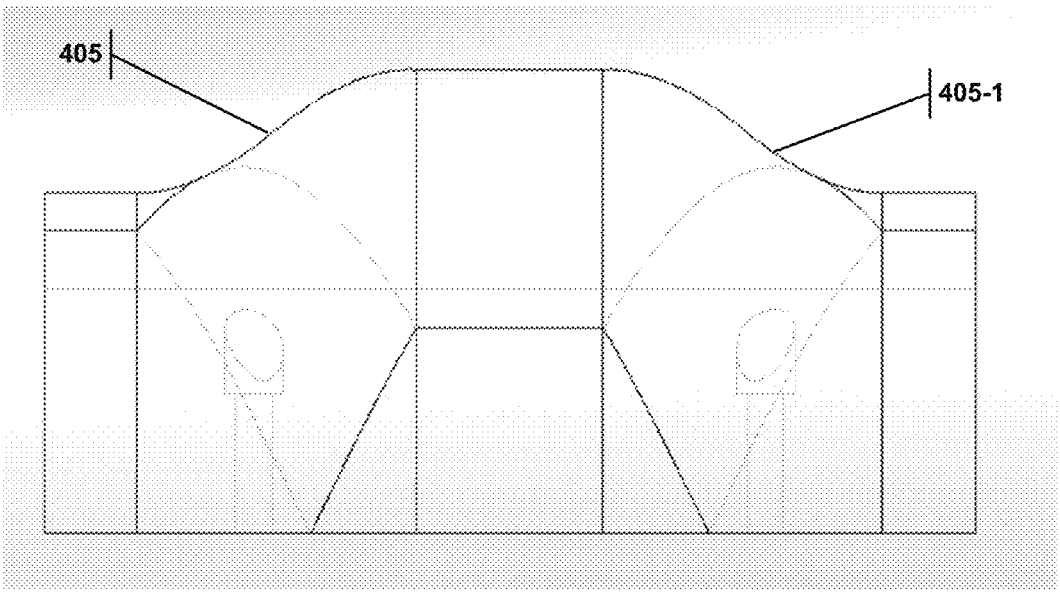
FIG. 8 is a side view of a half of a helical disc described herein.
Figure 9:
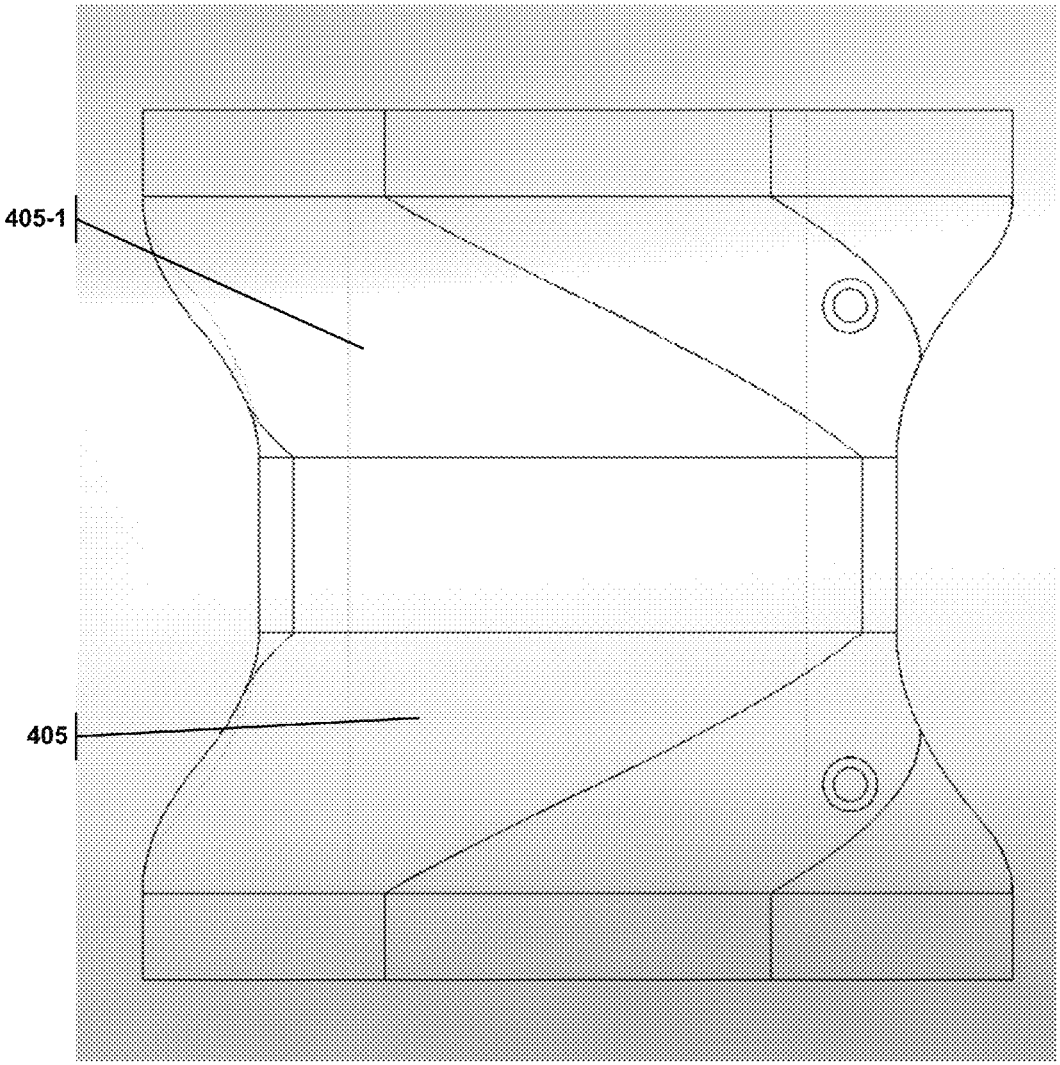
FIG. 9 is a top view of a half of a helical disc described herein.
Figure 10:
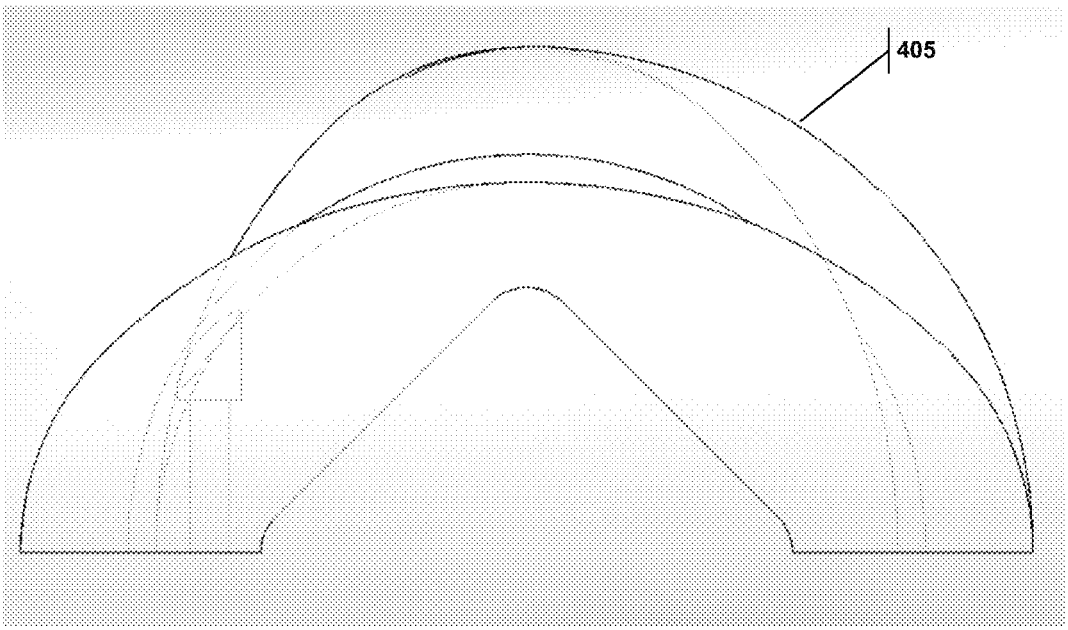
FIG. 10 is a side view of a half of a helical disc described herein.

The space change illustrated in FIGS. 5A-5E is caused by the ridge 405 that forms a helical impacting surface. For example, in FIG. 5A, the helical ridge of the upper plurality of discs 505 is shown at position 520*a*, while the helical ridge of the lower plurality of discs 515 is shown at position 525*a*. In FIG. 5B, both pluralities of discs 500 and 505 have rotated about 45 degrees such that the helical ridge of the upper plurality of discs 505 is shown at position 520*b*, while the helical ridge of the lower plurality of discs 515 is shown at position 525*b*. In FIG. 5C, both pluralities of discs 500 and 505 have rotated another 45 degrees such that the helical ridge of the upper plurality of discs 505 is shown at position 520*c*, while the helical ridge of the lower plurality of discs 515 is shown at position 525*c*. In FIG. 5C, both pluralities of discs 500 and 505 have rotated another 45 degrees such that the helical ridge of the upper plurality of discs 505 is shown at position 520*c*, while the helical ridge of the lower plurality of discs 515 is shown at position 525*c*. In FIG. 5D, both pluralities of discs 500 and 505 have rotated another 45 degrees such that the helical ridge of the upper plurality of discs is now out of view on the back side of the disc, while the helical ridge of the lower plurality of discs 515 is shown at position 525*d*. In FIG. 5D, both pluralities of discs 500 and 505 have rotated another 45 degrees such that the helical ridge of the upper plurality of discs is still out of view on the back side of the disc, while the helical ridge of the lower plurality of discs 515 is shown at position 525*e*. While the rotational positions shown in FIGS. 5A-5E cover only 180 degrees, because the discs are made of identical halves each having its own helical ridge, the remaining 180 degrees of rotation are identical to those already described.

The major and minor axis of the discs produced movement in the plane of the shafts (i.e., the same plane as the paper). Consider position 540*a* of the plurality of discs 505, which moves down the plane of the shafts to position 540*b*, and then positions 540*c*, 540*d* and 540*e*. As the discs continue to rotate, this position will return to its topmost position shown at 540*a*. The differing sweep (i.e., 407 and 407-1) of the helical ridges (405 and 405-1) also cause the lateral movement to undulate into and away from the union of adjacent discs on the same shaft.

In order to create various sized intended spaces to separate materials of different sizes, the shafts upon which the discs are mounted can be spaced differently. Alternatively, the distance between the shafts can be left constant, but the diameter of the discs (i.e., the major/minor axes) can be altered to either bring adjacent discs closer together or farther apart.

By promoting lateral agitation, the disc screen can be operated more efficiently. In prior art systems which lack lateral agitation, the material to be sorted tends to stay in the middle portion of the disc screen and the edges of the disc screen process much less material. By having lateral agitation, the entire width of the disc screen (i.e., the length along the longitudinal axis of the shafts) can be utilized, so a disc screen with the same width can process more material using the helical discs described herein. Alternatively, the disc screen width can be reduced and process the same amount of material that a larger screen (using non-helical discs) could process. The point is that the helical discs move the material over a large portion of the screen which yields more efficient sorting.

While the embodiments above have been described with reference to a disc with outer helical ridges (i.e., the major axis) that are 180 degrees out of phase (see FIG. 4A, at 405 and 410), it would be apparent that other shapes can be used with different phases. For example, U.S. Pat. No. 5,960,964 (the entire contents of which are incorporated herein by reference) describes a step function disc screen with a variety of shapes, where the rotating adjacent discs maintain a near intended space width. The '964 patent, however, suffers from the same deficiencies as described above in the prior art. For example, because the discs are a step function along the longitudinal length of the shaft, material can become lodged between discs in an unintended sorting space, and the intended space between adjacent discs does not undulate so as to cause lateral movement of material along the length of the shafts longitudinal axis.

Figures 11A, 11B:
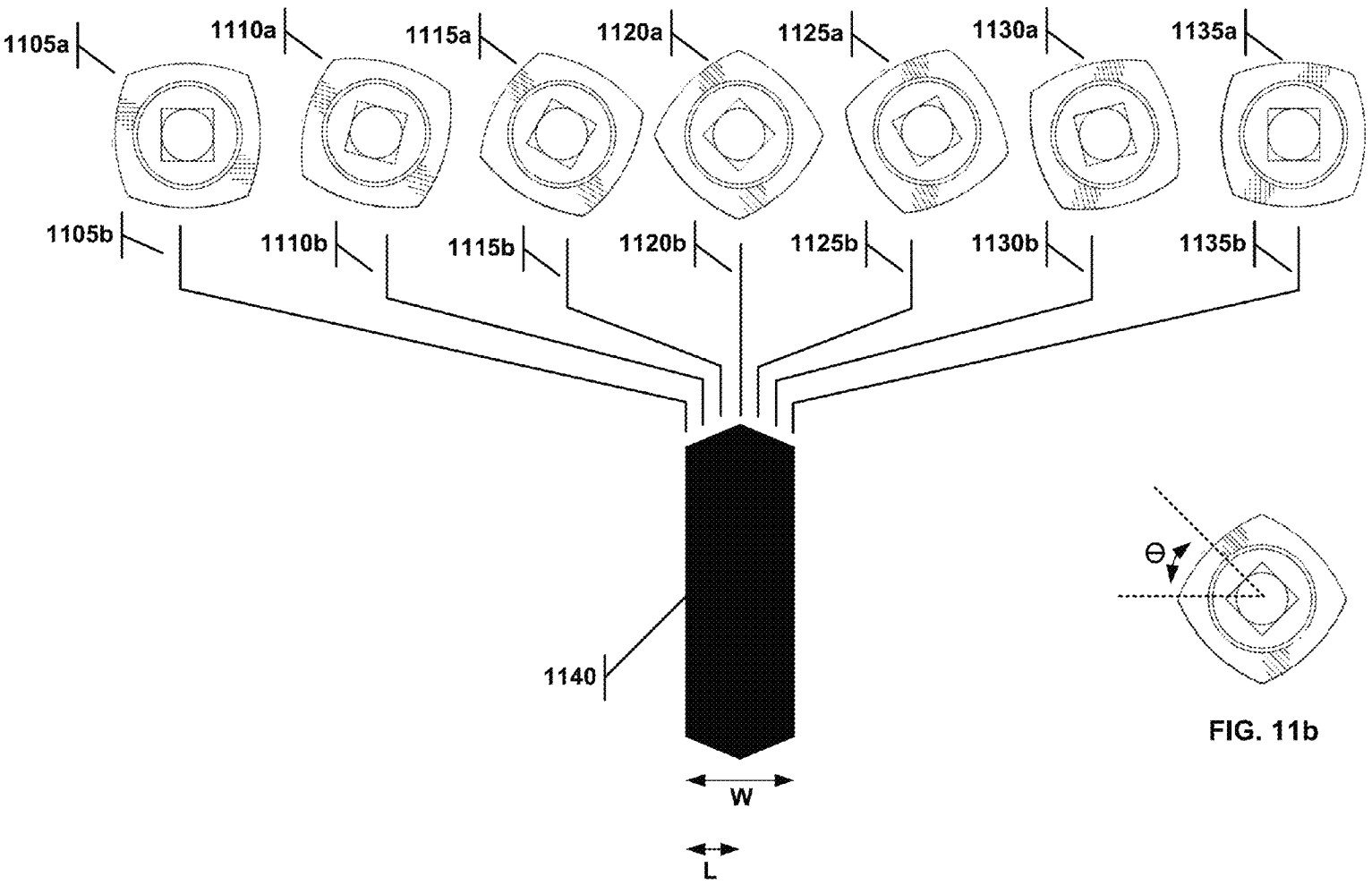
FIG. 11A illustrates a helical disc with four major axes.
FIG. 11B illustrates a helical disc with four major axes.

To obtain the undulation character of the intended space, the chosen disc shape should not be a step function along the longitudinal axis of the shaft. For example, a disc with four major axes could be used as shown in FIG. 11*a*. A side view of the disc is shown at 1140. A cross-sectional slice (normal to the side view 1140) is shown at 1105*a*, and this cross section is located at position shown by line 1105*b*. A second cross-sectional slice (normal to the side view 1140) is shown at 1110*a*, and this cross section is located at position shown by line 1110*b*. And a third, fourth, fifth, sixth and seventh cross-sectional slices are shown at 1115*a*, 1120*a*, 1125*a*, 1130*a*, and 1135, respectively. These cross sections are located at positions shown by lines 1115*b*, 1120*b*, 1125*b*, 1130*b*, and 1135*b*. The transition between the various cross sections is smooth and continuous so as to avoid a step function in the direction along the longitudinal axis of the shaft. Each cross section illustrated is a 15 degree rotation from the previous position. At 90 degrees of rotation, the disc is identical to its starting position. The rotation of the cross section from the starting position shown cross section 1105 can be defined as follows:

$$\theta = L/W \times 90 \text{ degrees}$$

Where:

W is the width of the disc

L is the distance along the width into the disc.

Figure 12:
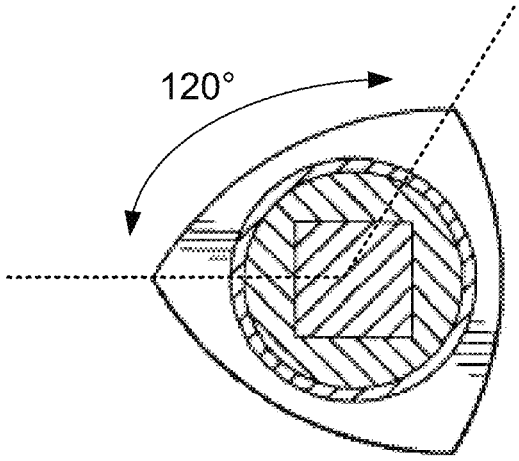
FIG. 12 illustrates a helical disc with three major axes.

A disc with three major axes (FIG. 12) can also be used to create the non-step function undulation and lateral agitation described above. The rotation of the cross section from the starting position can be defined as follows $$\theta = L/W \times 120 \text{ degrees}$$

Where:

W is the width of the disc

L is the distance along the width into the disc.

Figure 13:
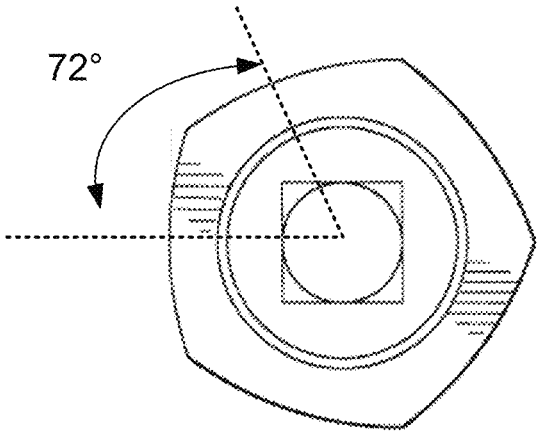
FIG. 13 illustrates a helical disc with five major axes.

Similarly a disc with five major axes (FIG. 13) can also be used to create the non-step function undulation and lateral agitation described above. The rotation of the cross section from the starting position can be defined as follows $$\theta = L/W \times 72 \text{ degrees}$$

Where:

W is the width of the disc

L is the distance along the width into the disc.

To increase the efficiency of the screen, the helical ridges may be textured, which allows more material to pass through the disc screen. The texturing of the helical ridge increases the efficiency of the disc screen by reducing the "air pillow" effect. During operation the discs are rotated at very high speed and the discs act as air impellers that create an "air pillow" upon which the material to be classified may float. The material, therefore, is not contacted by the discs and does not travel through the disc screen's intended space. Texturing overcomes this inefficiency in several ways. For example, texturing creates a larger surface area which contacts the material to be classified and thus has a higher possibility of forcing the material through the disc screen. Texturing also allows the tips of the textured pattern to flex when they come into contact with the materials to be classified, again increasing the contact surface area and the efficiency in pushing the material through the disc screen. Finally, texturing creates channels through which air can evacuate, while simultaneously allowing the tips of the textured pattern to come into contact with the material to be classified.

Testing of the disc screen with the disclosed helical disc confirms that the sorting is much more efficient than prior disc designs. And because it is more efficient the helical ridges may wear more quickly because they are potentially processing more material. To address this, the helical ridges may comprise a material having physical or chemical properties different than that of the material used to form the remainder of the disc. The different physical or chemical properties give helical ridges one or more desirable characteristics, such as greater durability, increased coefficient of friction, reduced material costs, or some combination of these and/or others. For example, helical ridges in one embodiment could be made of a material that is more durable than the material used for the rest of the disc. In another embodiment, the material used to form the helical ridges is the same material as that of the rest of the disc, but has additives that result in a physical property being different from a physical property of the material alone. For example, one or more additives could be added to polyurethane to make the material that forms the helical ridges harder, softer, more durable, less costly, or of greater durometer. Such additives are well-known in the art. In another embodiment, the material used to form the helical ridges has a higher, or lower, coefficient of friction than the remaining portion of the disc. In one embodiment, the disc comprises a low durability material, while the helical ridges are textured using a high-durability material. In this way, only a small quantity of high-quality material is used, thus reducing material costs, while affording helical ridge with desirable chemical and mechanical properties for engaging particular types of recyclable materials, such as paper. The high-durability material provides better wear life while decreasing performance, while the texturing increases performance while decreasing wear life. The net effect is a disc having much better performance and wear properties with only a marginal increased cost.

The invention has been described in connection with specific embodiments that illustrate examples of the invention but do not limit its scope. Various example systems have been shown and described having various aspects and elements. Unless indicated otherwise, any feature, aspect or element of any of these systems may be removed from, added to, combined with or modified by any other feature, aspect or element of any of the systems. As will be apparent to persons skilled in the art, modifications and adaptations to the above-described systems and methods can be made without departing from the spirit and scope of the invention, which is defined only by the following claims. Moreover, the applicant expressly does not intend the following claims "and the embodiments in the specification to be strictly coextensive." *Phillips v. AHW Corp.*, 415 F.3d 1303, 1323 (Fed. Cir. 2005) (en banc).

I claim:

1. A disc for use in a disc screen, the disc having a longitudinal axis, the disc comprising:

a body extending a length along the longitudinal axis;

the body comprising a first major axis and a first minor axis, as defined by a first cross section taken perpendicular to the longitudinal axis at a first position along the length, the first major axis defining a first outer peripheral ridge with a diameter as defined by the distance from the first outer peripheral ridge to the center of the body, and the first major axis is substantially horizontal;

the body comprising a second major axis and a second minor axis, as defined by a second cross section taken perpendicular to the longitudinal axis at a second position along the length, the second major axis defining a second outer peripheral ridge, wherein the second major axis is not substantially horizontal;

a helical ridge in the direction of the longitudinal axis formed by a substantially continuous and non-stepwise surface between the first and second outer peripheral ridges, wherein the helical ridge substantially maintains the diameter between the first and second outer peripheral ridges.

2. The disc of claim 1, wherein an angle of rotation is greater than 15 degrees, the angle of rotation defined as the angle between a line originating at the center of the body and extending to the first outer peripheral ridge and a line originating at the center of the body and extending to the second outer peripheral ridge.

3. The disc of claim 2, wherein the angle of rotation is greater than 30 degrees.

4. The disc of claim 2, wherein the angle of rotation is at least 90 degrees.

5. The disc of claim 1, wherein the body is comprised of elastomeric material.

6. The disc of claim 1, wherein the disc is mounted onto a shaft and the body further comprises a central opening into which the shaft is disposed.

7. The disc of claim 6, wherein the body is constructed of more than one piece adapted to be fastened together around the shaft.

8. The disc of claim 1, wherein the first cross section has at least two major axes.

9. The disc of claim 1, wherein the first cross section has three, four or five major axes.

10. The disc of claim 1, wherein the first outer peripheral ridge and the second outer peripheral ridge are comprised of a material and the remainder of the body is comprised of a different material.

11. The disc of claim 1, wherein the first outer peripheral ridge and the second outer peripheral ridge are textured.

12. A material separation disc screen apparatus for separating materials, comprising:

a frame;

one or more multi-disc assemblies mounted to the frame in a substantially parallel relationship with each other, the multi-disc assemblies defining a longitudinal axis;

each multi-disc assembly comprising a plurality of discs, each disc comprising:

a body extending a length along the longitudinal axis;

the body comprising a first major axis and a first minor axis, as defined by a first cross section taken perpendicular to the longitudinal axis at a first position along the length, the first major axis defining a first outer peripheral ridge with a diameter as defined by the distance from the first outer peripheral ridge to the center of the body, and the first major axis is substantially horizontal;

the body comprising a second major axis and a second minor axis, as defined by a second cross section taken perpendicular to the longitudinal axis at a second position along the length, the second major axis defining a second outer peripheral ridge, wherein the second major axis is not substantially horizontal;

a helical ridge in the direction of the longitudinal axis formed by a substantially continuous and non-stepwise surface between the first and second outer peripheral ridges, wherein the helical ridge substantially maintains the diameter between the first and second outer peripheral ridges.

13. The screen of claim 12, wherein the multi-disc assembly comprises a first disc adjacent to a second disc, wherein the helical ridge of the first disc sweeps in a rotation along the longitudinal axis and the helical ridge of the second disc sweeps in an opposite rotation along the longitudinal axis.

14. The screen of claim 12, wherein an angle of rotation is greater than 15 degrees, the angle of rotation defined as the angle between a line originating at the center of the body and extending to the first outer peripheral ridge and a line originating at the center of the body and extending to the second outer peripheral ridge.

15. The screen of claim 14, wherein the angle of rotation is greater than 30 degrees.

16. The screen of claim 14, wherein the angle of rotation is at least 90 degrees.

17. The screen of claim 12, wherein the body is comprised of elastomeric material.

18. The screen of claim 12, wherein the one or more multi-disc assemblies is mounted to one or more shafts mounted on the frame, and the body of each disc further comprises a central opening into which the shaft is disposed.

19. The screen of claim 18, wherein the body of each disc is constructed of more than one piece adapted to be fastened together around the shaft.

20. The screen of claim 12, wherein the first cross section has at least two major axes.

21. The screen of claim 12, wherein the first cross section has three, four or five major axes.

22. The screen of claim 12, wherein the first outer peripheral ridge and the second outer peripheral ridge are comprised of a material and the remainder of the body is comprised of a different material.

23. The screen of claim 12, wherein the first outer peripheral ridge and the second outer peripheral ridge are textured.

* * * * *